US011048194B2

(12) United States Patent
Itoh et al.

(10) Patent No.: US 11,048,194 B2
(45) Date of Patent: Jun. 29, 2021

(54) FIXING DEVICE, IMAGE FORMING APPARATUS, AND HEAT- CONDUCTING MULTILAYER BODY

(71) Applicant: FUJIFILM Business Innovation Corp., Tokyo (JP)

(72) Inventors: Kazuyoshi Itoh, Kanagawa (JP); Kiyoshi Koyanagi, Kanagawa (JP); Takaaki Sato, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/292,340

(22) Filed: Mar. 5, 2019

(65) Prior Publication Data

US 2020/0073300 A1 Mar. 5, 2020

(30) Foreign Application Priority Data

Sep. 3, 2018 (JP) ..... JP2018-164381

(51) Int. Cl.
*G03G 15/20* (2006.01)

(52) U.S. Cl.
CPC ..... *G03G 15/2053* (2013.01); *G03G 15/2039* (2013.01); *G03G 15/2042* (2013.01); *G03G 2215/2035* (2013.01)

(58) Field of Classification Search
CPC ..... G03G 15/2053; G03G 15/2039; G03G 2215/2035; G03G 15/2042; G03G 15/2046
See application file for complete search history.

(56) References Cited

U.S. PATENT DOCUMENTS 9,471,016 B2 10/2016 Nakada et al.
2014/0169845 A1* 6/2014 Nakahara ..... G03G 15/2053 399/328
2015/0139708 A1* 5/2015 Shimura ..... G03G 15/2042 399/329
2015/0338795 A1* 11/2015 Yamaguchi ..... G03G 15/206 219/216

(Continued)

FOREIGN PATENT DOCUMENTS

JP H05-289555 11/1993
JP 2015-152752 8/2015

*Primary Examiner* — Walter L Lindsay, Jr.
*Assistant Examiner* — Laura Roth
(74) *Attorney, Agent, or Firm* — JCIPRNET

(57) ABSTRACT

A fixing device includes a contact portion contacting a recording material transported; a heat source heating the contact portion and including a heat generator extending in a width direction intersecting a transport direction in which the recording material is transported, and a support portion supporting the heat generator, the heat source having a counter surface facing the contact portion, and an opposite surface; a high-thermal-conductivity portion is provided on the opposite surface of the heat source and extends in the width direction such that a part of the high-thermal-conductivity portion overlaps the heat generator of the heat source, the high-thermal-conductivity portion having a higher thermal conductivity than the support portion or the contact portion. A length of an area of overlap between the high-thermal-conductivity portion and the heat generator of the heat source in the transport direction is shorter in a width-direction central portion than in two width-direction end portions.

14 Claims, 9 Drawing Sheets

(56) References Cited

U.S. PATENT DOCUMENTS

| | | | | |
|---|---|---|---|---|
| 2015/0338803 | A1* | 11/2015 | Hirose | G03G 15/2053 399/329 |
| 2016/0246229 | A1* | 8/2016 | Taguchi | G03G 15/2053 |
| 2017/0102651 | A1* | 4/2017 | Tanaka | G03G 15/2039 |

* cited by examiner

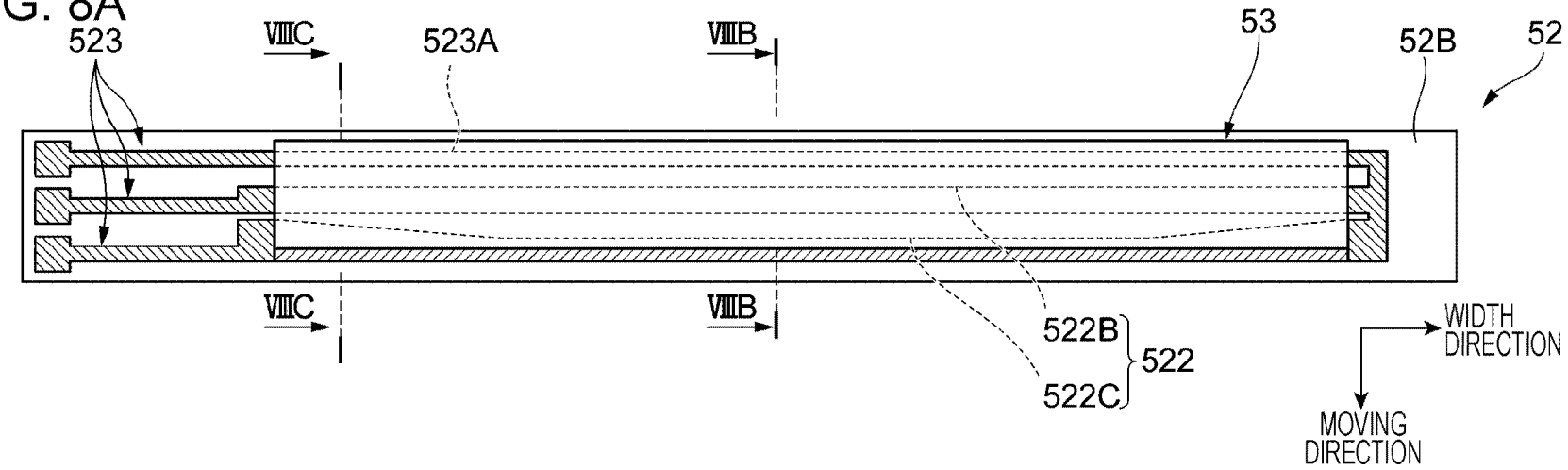
FIG. 8A
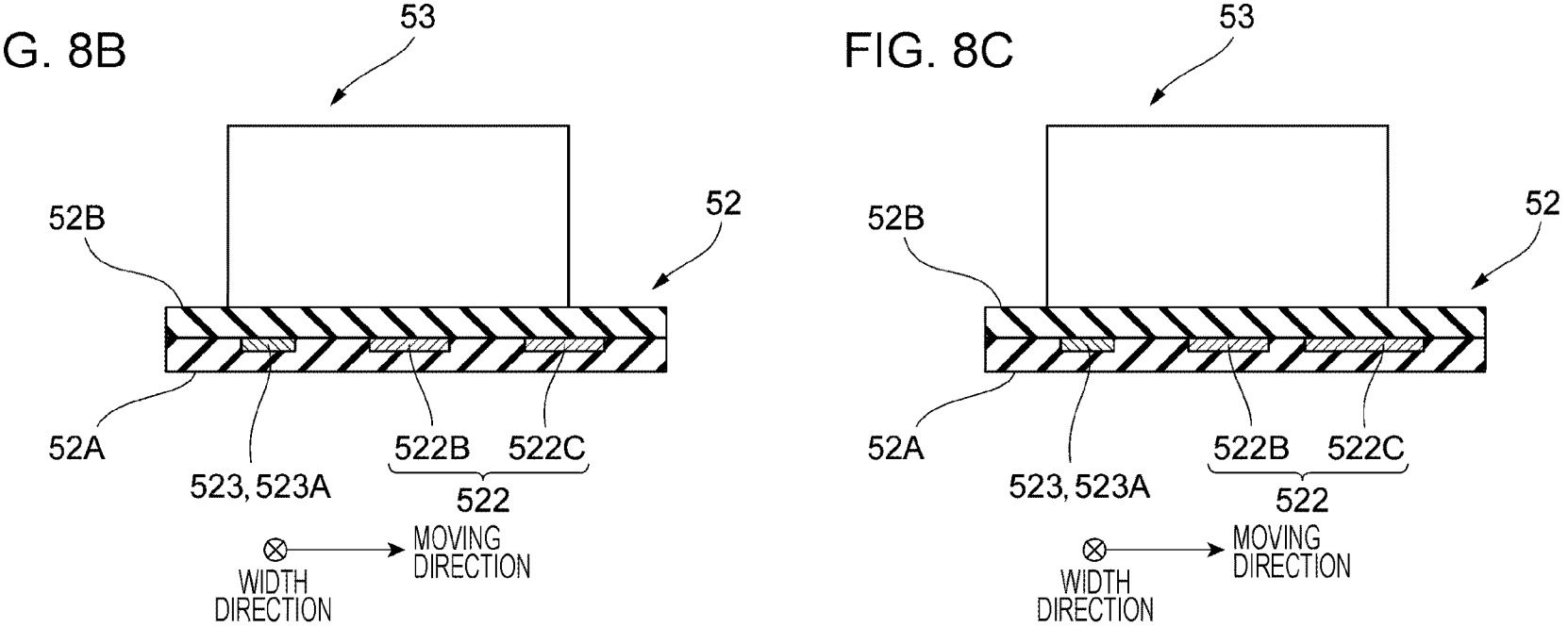
FIG. 8C
FIG. 8B

FIXING DEVICE, IMAGE FORMING APPARATUS, AND HEAT- CONDUCTING MULTILAYER BODY

CROSS-REFERENCE TO RELATED APPLICATIONS

This application is based on and claims priority under 35 USC 119 from Japanese Patent Application No. 2018-164381 filed Sep. 3, 2018.

BACKGROUND

(i) Technical Field

The present disclosure relates to a fixing device, an image forming apparatus, and a heat-conducting multilayer body.

(ii) Related Art

There is a related-art technique applied to a fixing device that includes a heating member having a heat generating body provided on a substrate, and a film sliding on the heating member. In this technique, the rise of the temperature of a non-sheet-passing portion is suppressed by providing a high-thermal-conductivity member on a side of the heating member opposite a side of contact with the film (see Japanese Unexamined Patent Application Publication No. 5-289555).

SUMMARY

In the fixing device, for example, a contact portion such as a belt that comes into contact with a recording material is heated by a heat source, and the heated contact portion is brought into contact with the recording material, whereby an image formed on the recording material is fixed.

In such a fixing device, when, for example, an image formed on a recording material having a width smaller than the width of the heat source is fixed, heat generated by the heat source is not consumed in non-sheet-passing areas that are at two respective ends of the heat source. Consequently, in the non-sheet-passing areas, the temperature of the contact portion may rise excessively. To suppress the occurrence of such a situation, there are some fixing devices that each include, for example, a high-thermal-conductivity portion having a higher thermal conductivity than the contact portion and so forth and provided over the heat source.

In a fixing device including such a high-thermal-conductivity portion, for example, if the length of the area of overlap between the high-thermal-conductivity portion and the heat generator of the heat source in a transport direction is equal between width-direction end portions and a width-direction central portion, it may take a long time to heat the contact portion to a predetermined temperature at the start of heating of the contact portion by the heat source.

Aspects of non-limiting embodiments of the present disclosure relate to making the time required for heating the contact portion shorter than in the case where the length of the area of overlap between the high-thermal-conductivity portion and the heat generator of the heat source in the transport direction is equal between the width-direction end portions and the width-direction central portion.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a fixing device including a contact portion that comes into contact with a recording material transported; a heat source that heats the contact portion and includes a heat generator extending in a width direction intersecting a transport direction in which the recording material is transported, and a support portion supporting the heat generator, the heat source having a counter surface that faces the contact portion, and an opposite surface; and a high-thermal-conductivity portion provided on the opposite surface of the heat source and extending in the width direction such that at least a part of the high-thermal-conductivity portion overlaps the heat generator of the heat source, the high-thermal-conductivity portion having a higher thermal conductivity than at least one of materials forming the support portion and the contact portion. A length of an area of overlap between the high-thermal-conductivity portion and the heat generator of the heat source in the transport direction is shorter in a width-direction central portion than in two width-direction end portions.

BRIEF DESCRIPTION OF THE DRAWINGS

Exemplary embodiments of the present disclosure will be described in detail based on the following figures, wherein:

FIGS. 8A to 8C illustrate an arrangement of a heat source and a high-thermal-conductivity portion according to a fourth exemplary embodiment.

DETAILED DESCRIPTION

First Exemplary Embodiment

Figure 1:
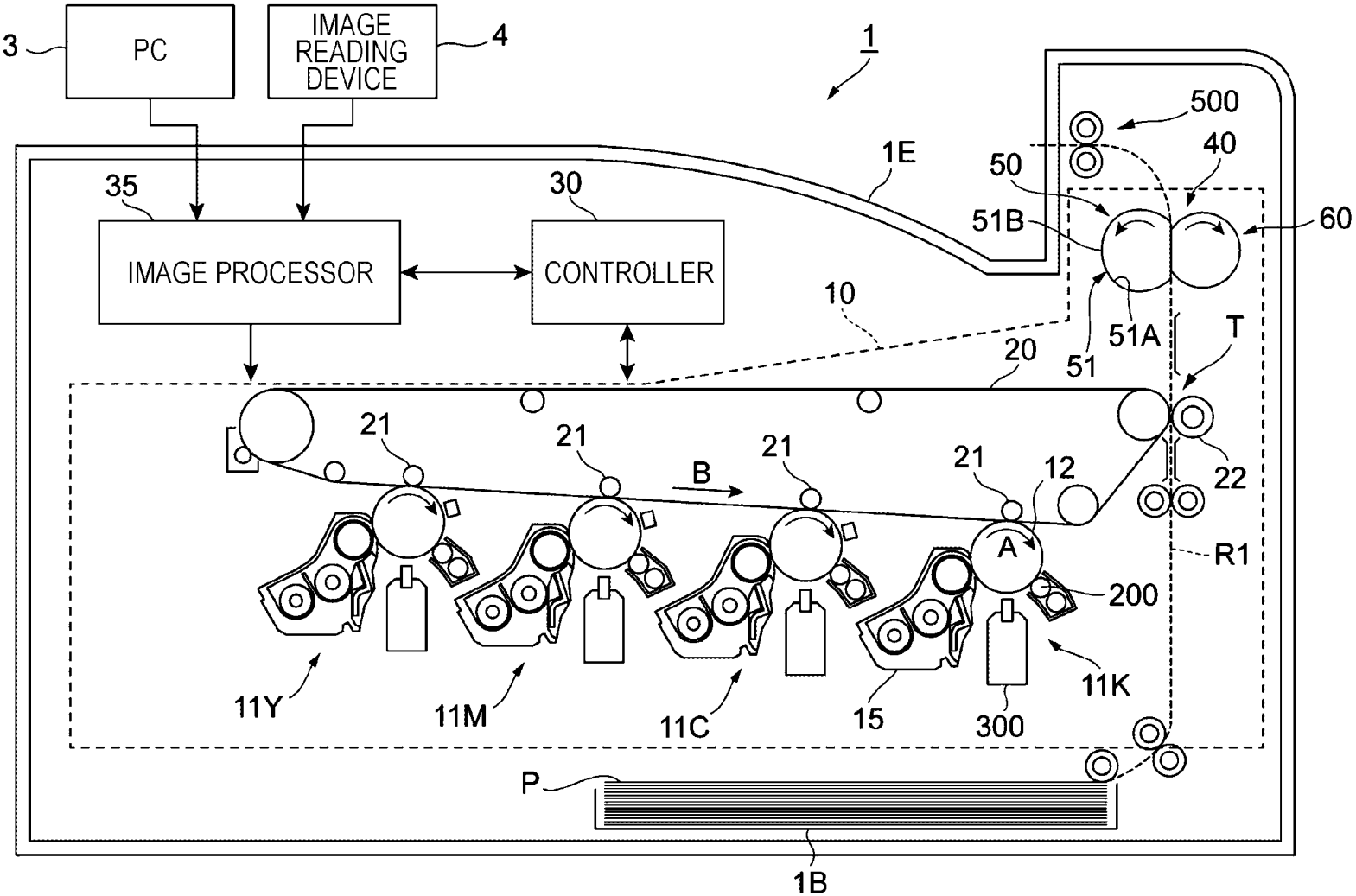
FIG. 1 illustrates an overall configuration of an image forming apparatus.

FIG. 1 illustrates an overall configuration of an image forming apparatus 1.

The image forming apparatus 1 is a so-called tandem-type color printer.

The image forming apparatus 1 includes an image forming section 10 as an exemplary image forming device. The image forming section 10 forms an image on a sheet P as an exemplary recording material in accordance with pieces of image data for different colors.

The image forming apparatus 1 further includes a controller 30 and an image processor 35.

The controller 30 controls relevant functional elements included in the image forming apparatus 1.

The image processor 35 processes the pieces of image data received from a device such as a personal computer (PC) 3 or an image reading device 4.

The image forming section 10 includes four image forming units 11Y, 11M, 11C, and 11K (hereinafter also generally denoted as "image forming units 11") arranged at intervals and in parallel.

The image forming units 11 all have the same configuration, but different kinds of toner are stored in respective developing devices 15 (to be described below). The image forming units 11 form toner images (images) in respective colors of yellow (Y), magenta (M), cyan (C), and black (K).

The image forming units 11 each include a photoconductor drum 12, a charger 200 that charges the photoconductor drum 12, and a light-emitting-diode (LED) printhead (LPH) 300 that exposes the photoconductor drum 12 to light.

The photoconductor drum 12 is charged by the charger 200. Furthermore, the photoconductor drum 12 is exposed to light emitted from the LPH 300, whereby an electrostatic latent image is formed on the photoconductor drum 12.

The image forming units 11 each further include the developing device 15 that develops the electrostatic latent image formed on the photoconductor drum 12, and a cleaner (not illustrated) that cleans the surface of the photoconductor drum 12.

The image forming section 10 includes an intermediate transfer belt 20 to which the toner images in the respective colors formed on the respective photoconductor drums 12 are transferred, and first transfer rollers 21 with which the toner images in the respective colors formed on the respective photoconductor drums 12 are transferred sequentially to the intermediate transfer belt 20 (first transfer).

The image forming section 10 further includes a second transfer roller 22 with which the toner images transferred to the intermediate transfer belt 20 are collectively transferred to the sheet P (second transfer), and a fixing device 40 that fixes the toner images to the sheet P.

The fixing device 40 includes a fixing belt module 50 and a pressing roller 60. The fixing belt module 50 includes a heat source 52 (see FIG. 2).

The fixing belt module 50 is provided on the left side, in FIG. 1, of a sheet transport path R1. The pressing roller 60 is provided on the right side, in FIG. 1, of the sheet transport path R1 and is pressed against the fixing belt module 50.

The fixing belt module 50 includes a film-type fixing belt 51 that comes into contact with the sheet P.

The fixing belt 51 is an exemplary contact portion and includes, for example, a releasing layer forming an outermost layer that comes into contact with the sheet P, an elastic layer provided immediately on the inner side of the releasing layer, and a base layer supporting the elastic layer.

The fixing belt 51 has an endless shape and rotates counterclockwise in FIG. 1. An inner peripheral surface 51A of the fixing belt 51 is lubricated with a lubricant so that the sliding resistance between the fixing belt 51 and the heat source 52 and so forth to be described below is reduced. Examples of the lubricant include liquid oils such as silicone oil and fluorine oil, a mixture of a solid substance and liquid such as grease, and a combination of the foregoing materials. These kinds of lubricant are each exemplary heat-conducting viscous liquid.

The fixing belt 51 comes into contact with the sheet P that is transported from the lower side in FIG. 1, and a portion of the fixing belt 51 that has come into contact with the sheet P moves with the sheet P, whereby the sheet P is nipped between the fixing belt 51 and the pressing roller 60. Thus, the fixing belt 51 presses and heats the sheet P.

The fixing belt module 50 includes the heat source 52 (to be described below) provided on the inner side of the fixing belt 51. The heat source 52 heats the fixing belt 51.

The pressing roller 60 is an exemplary pressing member and is provided on the right side, in FIG. 1, of the sheet transport path R1. The pressing roller 60 is pressed against an outer peripheral surface 51B of the fixing belt 51 and presses the sheet P passing through the nip between the fixing belt 51 and the pressing roller 60 (i.e., the sheet P moving along the sheet transport path R1).

The pressing roller 60 is caused to rotate clockwise in FIG. 1 by a motor (not illustrated). When the pressing roller 60 rotates clockwise, the fixing belt 51 receives a driving force from the pressing roller 60 and rotates counterclockwise.

In the image forming apparatus 1, the image processor 35 processes the pieces of image data received from the PC 3 or the image reading device 4, and the processed pieces of image data are supplied to the respective image forming units 11.

Then, in the image forming unit 11K for the black (K) color, for example, the photoconductor drum 12 is charged by the charger 200 while rotating in a direction of arrow A and is exposed to light emitted from the LPH 300 in accordance with a corresponding one of the pieces of image data received from the image processor 35.

Consequently, an electrostatic latent image based on the piece of image data for the black (K) color is formed on the photoconductor drum 12. The electrostatic latent image formed on the photoconductor drum 12 is then developed by the developing device 15, whereby a toner image in the black (K) color is formed on the photoconductor drum 12.

Likewise, other toner images in the colors of yellow (Y), magenta (M), and cyan (C) are formed in the image forming units 11Y, 11M, and 11C, respectively.

The toner images in the respective colors formed by the respective image forming units 11 are then sequentially electrostatically attracted by the respective first transfer rollers 21 to the intermediate transfer belt 20 rotating in a direction of arrow B, whereby a toner image composed of the toner images having the respective colors and superposed one on top of another is formed on the intermediate transfer belt 20.

With the rotation of the intermediate transfer belt 20, the toner image on the intermediate transfer belt 20 is transported to a position (a second transfer part T) where the second transfer roller 22 is provided. Then, in accordance with the timing of reaching of the toner image to the second transfer part T, a sheet P is supplied from a sheet container 1B to the second transfer part T.

In the second transfer part T, a transfer electric field generated by the second transfer roller 22 causes the toner image on the intermediate transfer belt 20 to be electrostatically transferred to the sheet P transported thereto.

Then, the sheet P having the toner image electrostatically transferred thereto is released from the intermediate transfer belt 20 and is transported to the fixing device 40.

In the fixing device 40, the sheet P is nipped between the fixing belt module 50 and the pressing roller 60. Specifically, the sheet P is nipped between the fixing belt 51 rotating counterclockwise and the pressing roller 60 rotating clockwise.

Thus, the sheet P is pressed and heated, whereby the toner image on the sheet P is fixed to the sheet P. The sheet P having undergone the fixing is transported to a sheet stacking portion lE by a pair of discharge rollers 500.

Figure 2:
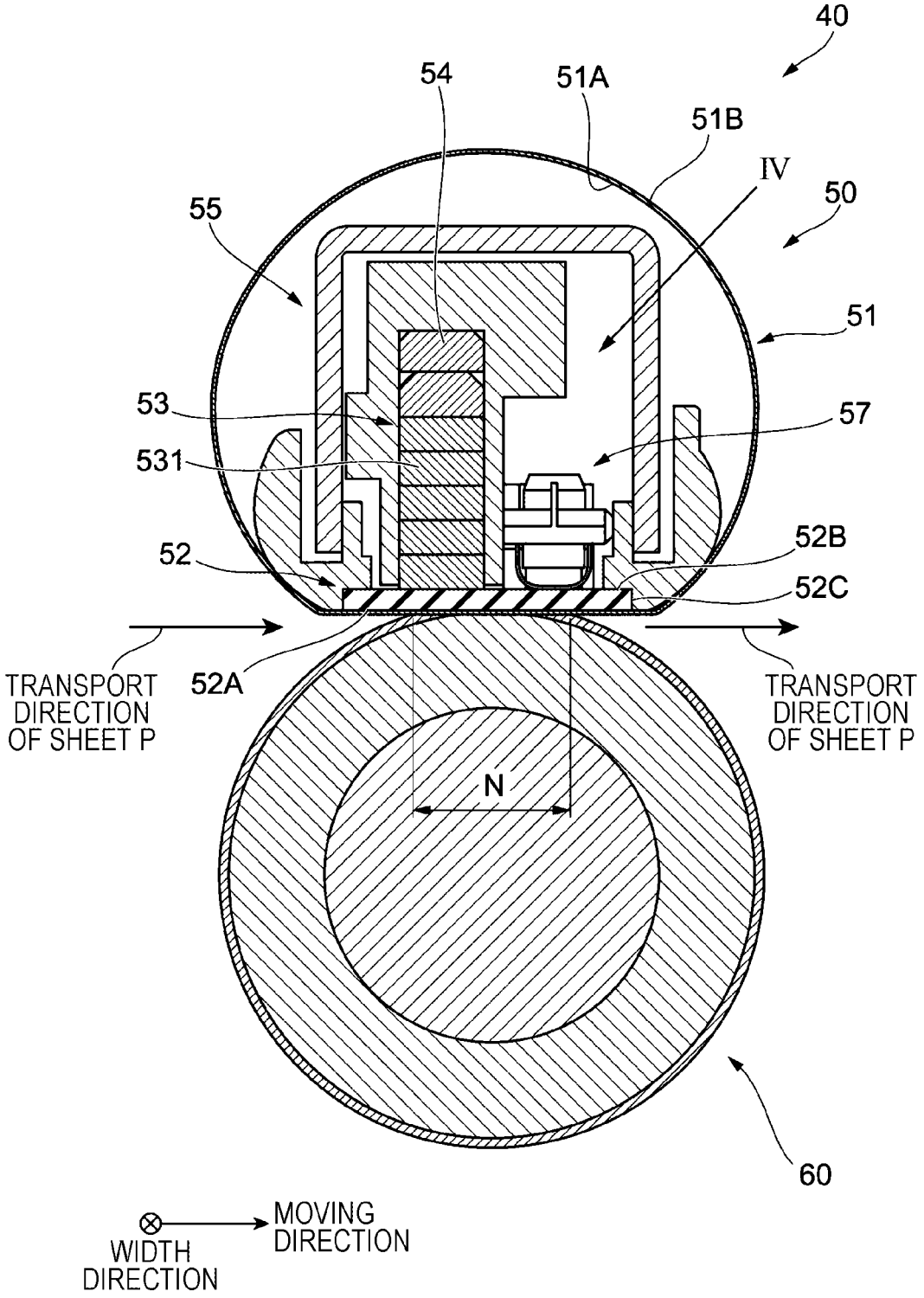
FIG. 2 illustrates a configuration of a fixing device.
Figure 3A:
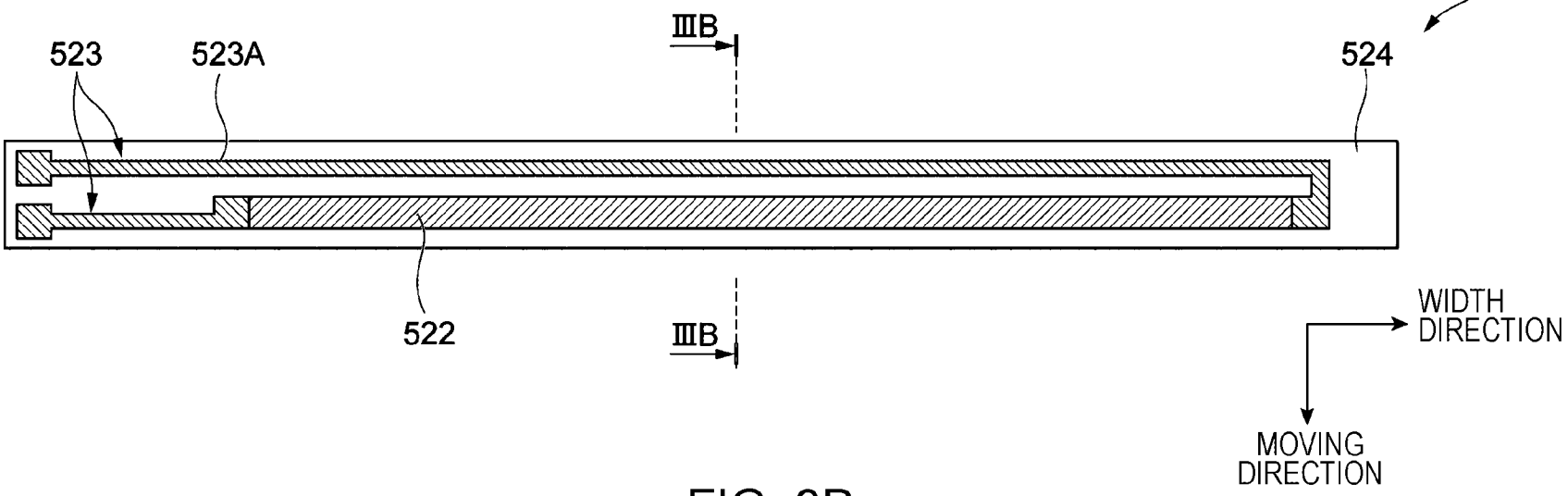
FIGS. 3A and 3B illustrate the configuration of the fixing device.
Figure 3B:
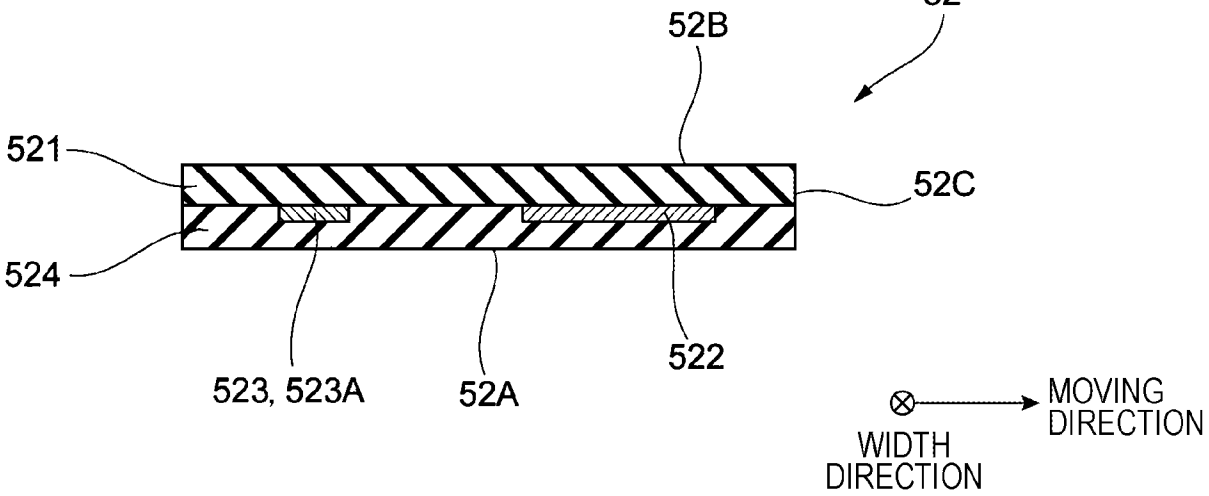

FIG. 2 and FIGS. 3A and 3B illustrate a configuration of the fixing device 40. FIG. 2 is a sectional view of the fixing device 40, more specifically, a sectional view of the fixing device 40 taken in a central portion of the fixing belt 51 in the width direction to be described below. FIGS. 3A and 3B illustrate a configuration of the heat source 52 to be described below.

As illustrated in FIG. 2, the fixing device 40 includes the fixing belt module 50 and the pressing roller 60.

The fixing belt module 50 includes the fixing belt 51 used for fixing the toner image to the sheet P. The fixing belt 51 is pressed against a side of the sheet P that has the toner image.

The pressing roller 60 is pressed against the outer peripheral surface 51B of the fixing belt 51 and thus presses the sheet P passing through the nip between the fixing belt 51 and the pressing roller 60.

Specifically, the pressing roller 60 is positioned in contact with the outer peripheral surface 51B of the fixing belt 51 and forms a nip part N in combination with the fixing belt 51. The nip part N formed between the pressing roller 60 and the fixing belt 51 is an area through which the sheet P passes while being pressed. In the first exemplary embodiment, in the process of the passing of the sheet P through the nip part N, the sheet P is heated and pressed, whereby the toner image is fixed to the sheet P.

Hereinafter, the direction in which the fixing belt 51 moves in the nip part N is referred to as the moving direction of the fixing belt 51 or simply the moving direction. The moving direction of the fixing belt 51 in the nip part N and the transport direction in which the sheet P is transported through the nip part N are the same. The width direction of the fixing belt 51 that is orthogonal to the moving direction is referred to as the width direction of the fixing belt 51 or simply the width direction.

As illustrated in FIG. 2, the fixing belt module 50 includes, on the inner side of the fixing belt 51, the heat source 52 that heats the fixing belt 51, and a high-thermal-conductivity portion 53 that receives the heat from the heat source 52. The fixing belt module 50 further includes, on the inner side of the fixing belt 51, a pressing member 54 that presses the high-thermal-conductivity portion 53 against the heat source 52; and a support member 55 that supports the heat source 52, the high-thermal-conductivity portion 53, and the pressing member 54. The fixing belt module 50 further includes, on the inner side of the fixing belt 51, a temperature sensor 57 that detects the temperature of the heat source 52.

The heat source 52 has a plate-like shape and extends in the moving direction of the fixing belt 51 and in the width direction of the fixing belt 51. The heat source 52 has a counter surface 52A that faces the fixing belt 51, and an opposite surface 52B on a side thereof opposite the counter surface 52A. The heat source 52 also has two side surfaces 52C that connect the counter surface 52A and the opposite surface 52B to each other. In the first exemplary embodiment, the counter surface 52A of the heat source 52 is in contact with the inner peripheral surface 51A of the fixing belt 51.

In the first exemplary embodiment, heat is supplied from the heat source 52 to the fixing belt 51, whereby the fixing belt 51 is heated. Furthermore, in the first exemplary embodiment, the pressing roller 60 is pressed against the counter surface 52A of the heat source 52 with the fixing belt 51 interposed therebetween.

As illustrated in FIGS. 3A and 3B, the heat source 52 includes a plate-like base layer 521, and a heat generating layer 522 and power feeding layers 523 that are provided on a side of the base layer 521 nearer to the fixing belt 51 and extend in the width direction of the fixing belt 51 (see FIG. 2) that is orthogonal to the plane of FIG. 2. The heat source 52 further includes a protection layer 524 having an insulating characteristic and that covers the heat generating layer 522 and the power feeding layers 523.

The base layer 521 of the heat source 52 is formed of a substrate made of a metal material such as SUS, with an insulating layer made of glass or the like provided thereon. The base layer 521 may alternatively be made of insulating ceramic or the like, such as aluminum nitride or alumina. The base layer 521 has a uniform thickness over the entirety thereof in the width direction of the fixing belt 51. In other words, the thickness of the base layer 521 is equal between end portions thereof and a central portion thereof in the width direction of the fixing belt 51. In addition, the heat capacity of the base layer 521 is equal between the end portions thereof and the central portion thereof in the width direction of the fixing belt 51.

The heat generating layer 522 of the heat source 52 is an exemplary heat generator and is a heating resistor that generates heat by receiving electric power. The heat generating layer 522 is made of, for example, AgPd or the like. In the first exemplary embodiment, as illustrated in FIG. 3A, the heat generating layer 522 extends in the width direction of the fixing belt 51. In the first exemplary embodiment, the heat generating layer 522 has a uniform thickness over the entirety thereof in the width direction of the fixing belt 51. Furthermore, the length of the heat generating layer 522 in the moving direction of the fixing belt 51 is uniform over the entirety thereof in the width direction of the fixing belt 51.

If the power supplied to the heat generating layer 522 and the thickness of the heat generating layer 522 are uniform, the amount of heat generated by the heat generating layer 522 is inversely proportional to the length of the heat generating layer 522 in a direction orthogonal to the direction of electrification of the heat generating layer 522 (in the first exemplary embodiment, the moving direction of the fixing belt 51). That is, the amount of heat generated by the heat generating layer 522 becomes greater as the length of the heat generating layer 522 in the moving direction of the fixing belt 51 becomes smaller.

The power feeding layers 523 of the heat source 52 are exemplary electrode portions and are connected to two width-direction ends of the heat generating layer 522, respectively, thereby feeding electric power to the heat generating layer 522. The power feeding layers 523 are made of metal having a lower resistance than the heat generating layer 522, for example, Ag, or AgPd or the like containing a greater ratio of Ag than the heat generating layer 522. The power feeding layers 523 generate substantially no heat even if an electric current is supplied thereto, unlike the heat generating layer 522.

In the first exemplary embodiment, as illustrated in FIG. 3A, one of the power feeding layers 523 includes an extended portion 523A provided adjacent to and on the upstream side with respect to the heat generating layer 522 in the moving direction of the fixing belt 51 and extending in the width direction of the fixing belt 51. In the first exemplary embodiment, the extended portion 523A of the power feeding layer 523 is bent at one width-direction end thereof (the right end in FIG. 3A), and the bent end is connected to one end of the heat generating layer 522.

The protection layer 524 of the heat source 52 covers and protects the heat generating layer 522 and the power feeding layers 523 provided on the base layer 521. The protection layer 524 is made of, for example, baked glass having an insulating characteristic.

The pressing member 54 (see FIG. 2) is provided between the high-thermal-conductivity portion 53 (see FIG. 2) and the support member 55 (see FIG. 2) and presses the high-thermal-conductivity portion 53 against the opposite surface 52B of the heat source 52. The pressing member 54 brings a plurality of high-thermal-conductivity members 531, to be described below, included in the high-thermal-conductivity portion 53 into close contact with one another.

The pressing member 54 is an elastic member, such as a compression spring or a rubber member, and presses the high-thermal-conductivity portion 53 against the heat source 52 with the elastic restoring force thereof.

The high-thermal-conductivity portion 53 is provided on the opposite surface 52B of the heat source 52 and in contact therewith and receives heat from the heat source 52. In the description of the first exemplary embodiment, the state where the high-thermal-conductivity portion 53 is provided on the opposite surface 52B of the heat source 52 and in contact therewith includes not only a state where the high-thermal-conductivity portion 53 is provided directly on the opposite surface 52B of the heat source 52 but also a state where the high-thermal-conductivity portion 53 is provided on the opposite surface 52B of the heat source 52 with, for example, heat-conducting grease or the like interposed therebetween. In other words, the heat source 52 is configured to supply heat to the high-thermal-conductivity portion 53. The heat source 52 is exemplary another member.

The high-thermal-conductivity portion 53 according to the first exemplary embodiment includes the plurality of high-thermal-conductivity members 531 each having a plate-like shape and that are stacked one on top of another with heat-conducting grease or the like interposed therebetween. The high-thermal-conductivity portion 53 formed of the stack of the high-thermal-conductivity members 531 generally has a block-like shape.

The high-thermal-conductivity members 531 forming the high-thermal-conductivity portion 53 are each made of a material having a higher thermal conductivity than at least one of the materials forming the fixing belt 51 and the base layer 521 and the protection layer 524 of the heat source 52. The high-thermal-conductivity members 531 may each be made of a material having a higher thermal conductivity than the material forming the fixing belt 51.

The material forming the high-thermal-conductivity members 531 may be, for example, metal such as copper or aluminum, or an alloy such as SUS. The high-thermal-conductivity members 531 may all be made of the same material or different materials.

In the first exemplary embodiment, the high-thermal-conductivity portion 53 includes the stack of the high-thermal-conductivity members 531 each having a plate-like shape. Therefore, when the high-thermal-conductivity portion 53 is pressed by the pressing member 54, the high-thermal-conductivity members 531 deform independently of one another. Hence, the high-thermal-conductivity portion 53 comes into contact with the opposite surface 52B of the heat source 52 more closely than in a case where, for example, the high-thermal-conductivity portion 53 is formed of a single block-like member.

The high-thermal-conductivity portion 53 supplies heat generated in a portion of the heat source 52 that is at a high temperature to another portion of the heat source 52 that is at a low temperature.

If the sheet P to be subjected to the fixing process has a small width, the temperature of the heat source 52 tends to rise in non-sheet-passing areas that are at the two width-direction ends of the heat source 52 and do not come into contact with the sheet P. In such a case, temperature non-uniformity in the width direction may occur in the heat source 52 and in the fixing belt 51. If the fixing process of any sheet P having a larger width is performed after the occurrence of such temperature nonuniformity, fixing non-uniformity may occur.

In contrast, if the high-thermal-conductivity portion 53 is provided, the heat of the portion of the heat source 52 that is at a high temperature is supplied to the portion of the heat source 52 that is at a low temperature. Therefore, the temperature nonuniformity in the heat source 52 and in the fixing belt 51 is reduced.

In the fixing device 40 including the high-thermal-conductivity portion 53 that receives heat from the heat source 52, when the fixing belt 51 starts to be heated by the heat source 52, the heat generated by the heat generating layer 522 of the heat source 52 is conducted not only to the fixing belt 51 but also to the high-thermal-conductivity portion 53. Therefore, depending on the relationship between the heat generating layer 522 of the heat source 52 and the high-thermal-conductivity portion 53, the heat conduction from the heat generating layer 522 of the heat source 52 to the fixing belt 51 may be slow, leading to an increase in the time required for heating the fixing belt 51 to a predetermined temperature. For example, if the length of an area of overlap between the high-thermal-conductivity portion 53 and the heat generating layer 522 of the heat source 52 in the moving direction of the fixing belt 51 is equal between end portions and a central portion in the width direction of the fixing belt 51, the time required for heating the fixing belt 51 to the predetermined temperature tends to increase.

In contrast, in the fixing device 40 according to the first exemplary embodiment, the length of the area of overlap between the high-thermal-conductivity portion 53 and the heat generating layer 522 of the heat source 52 in the moving direction of the fixing belt 51 is made shorter in the central portion in the width direction of the fixing belt 51 than in the two end portions in the width direction of the fixing belt 51 (hereinafter, the end portions in the width direction of the fixing belt 51 are also referred to as the width-direction end portions, and the central portion in the width direction of the fixing belt 51 is also referred to as the width-direction central portion). Thus, the increase in the time required for heating the fixing belt 51 is suppressed.

Now, the configuration of the high-thermal-conductivity portion 53 and the relationship between the high-thermal-conductivity portion 53 and the heat source 52 will be described in detail.

Figure 4:
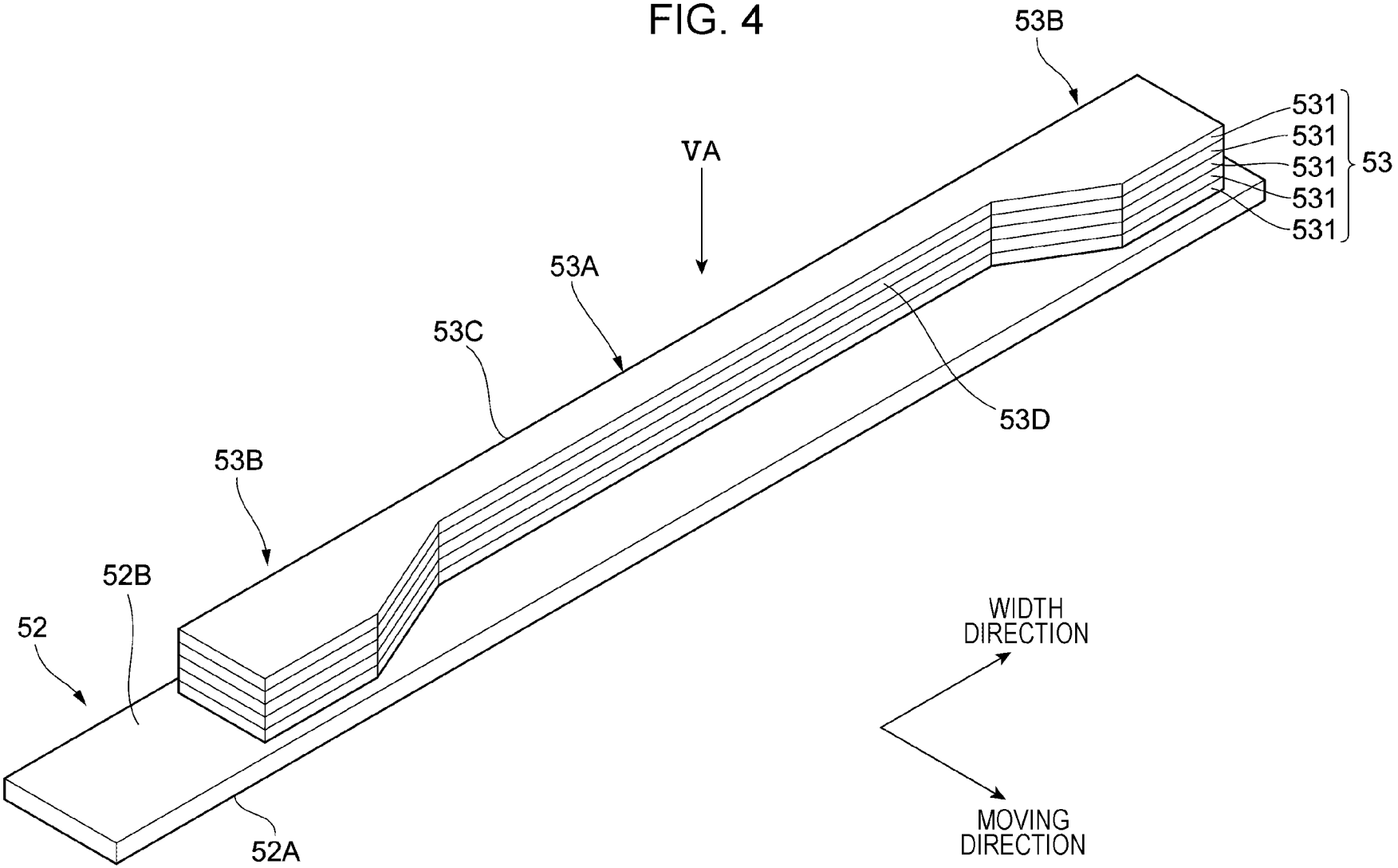
FIG. 4 illustrates an arrangement of a heat source and a high-thermal-conductivity portion according to a first exemplary embodiment.
Figure 5A:
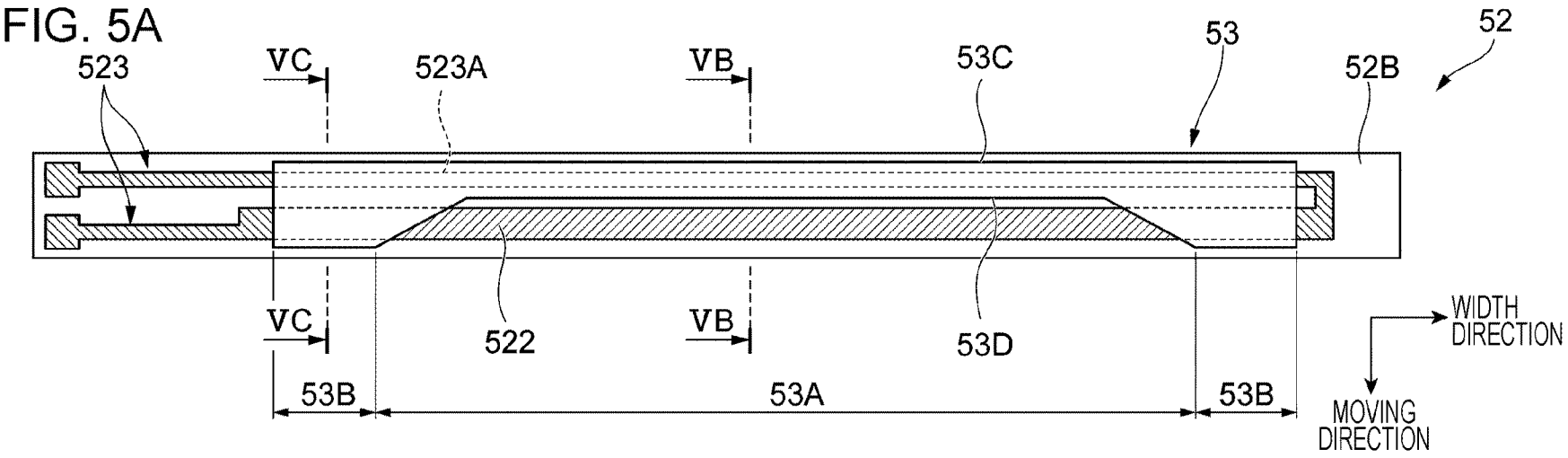
FIGS. 5A to 5C illustrate the arrangement of the heat source and the high-thermal-conductivity portion according to the first exemplary embodiment.
Figure 5C:
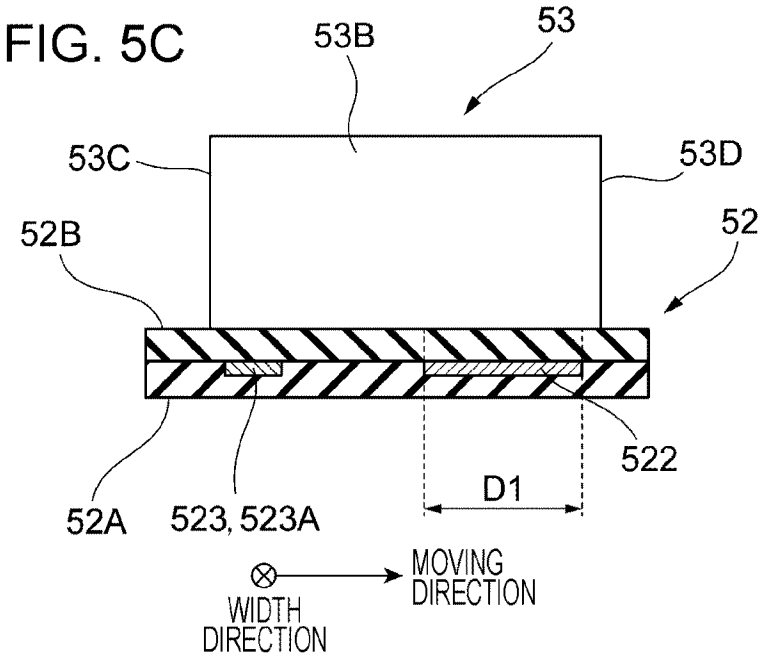
Figure 5B:
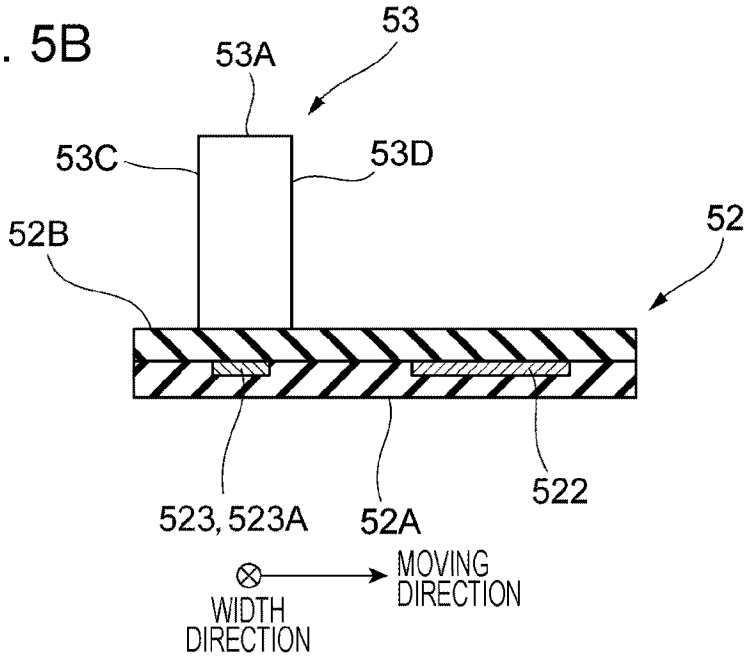

FIG. 4 and FIGS. 5A to 5C illustrate an arrangement of the heat source 52 and the high-thermal-conductivity portion 53 according to the first exemplary embodiment. FIG. 4 is a perspective view illustrating the heat source 52 and the high-thermal-conductivity portion 53. FIG. 5A is a plan view of the heat source 52 and the high-thermal-conductivity portion 53 seen in a direction VA represented in FIG. 4. FIG. 5B is a sectional view taken along line VB-VB illustrated in FIG. 5A. FIG. 5C is a sectional view taken along line VC-VC illustrated in FIG. 5A. In FIGS. 5A to 5C, the plurality of high-thermal-conductivity members 531 (see FIG. 4) are collectively illustrated as the high-thermal-conductivity portion 53. Hereinafter, the plurality of high-thermal-conductivity members 531 will be collectively described as the high-thermal-conductivity portion 53, occasionally.

As described above, the high-thermal-conductivity portion 53 generally has a block-like shape extending in the width direction of the fixing belt 51. In the first exemplary embodiment, as illustrated in FIG. 5A and others, the length of the high-thermal-conductivity portion 53 in the width direction is equal to the length of the heat generating layer 522 of the heat source 52 in the width direction.

Furthermore, as illustrated in FIGS. 4 and 5A, the high-thermal-conductivity portion 53 has a flat upstream side face 53C positioned on the upstream side in the moving direction, and a downstream side face 53D opposite and on the downstream side with respect to the upstream side face 53C in the moving direction. The upstream side face 53C and the downstream side face 53D each extend in the width direction. In the first exemplary embodiment, the distance between the downstream side face 53D and the upstream side face 53C in the moving direction is shorter in the width-direction central portion than in the width-direction end portions.

That is, the length of the high-thermal-conductivity portion 53 according to the first exemplary embodiment in the moving direction is shorter in the width-direction central portion than in the width-direction end portions. In other words, the high-thermal-conductivity portion 53 according to the first exemplary embodiment includes a narrow portion 53A positioned in the width-direction central portion thereof, and wide portions 53B positioned at two respective width-direction ends of the narrow portion 53A and being wider than the narrow portion 53A in the moving direction. In the first exemplary embodiment, the length of the narrow portion 53A in the moving direction gradually increases toward each of the wide portions 53B at the two respective width-direction ends of the narrow portion 53A.

As described above, the length of the heat generating layer 522 of the heat source 52 in the moving direction of the fixing belt 51 is uniform from one width-direction end thereof to the other width-direction end thereof.

Furthermore, in the first exemplary embodiment, as illustrated in FIGS. 5A to 5C, the length of the area of overlap between the high-thermal-conductivity portion 53 and the heat generating layer 522 of the heat source 52 in the moving direction is shorter in the width-direction central portion than in the width-direction end portions. Herein, the area of overlap between the high-thermal-conductivity portion 53 and the heat generating layer 522 refers to an area where the high-thermal-conductivity portion 53 and the heat generating layer 522 overlap each other when seen in a direction of stacking of the high-thermal-conductivity portion 53 on the heat source 52 (a direction orthogonal to the plane of FIG. 5A). The length of the area in the moving direction includes a length in a case where there is no overlap between the high-thermal-conductivity portion 53 and the heat generating layer 522 of the heat source 52 (i.e., a length of zero).

More specifically, as illustrated in FIGS. 5A and 5B, the narrow portion 53A of the high-thermal-conductivity portion 53 and the heat generating layer 522 of the heat source 52 do not overlap each other in the width-direction central portion. In other words, the length of the area of overlap between the high-thermal-conductivity portion 53 and the heat generating layer 522 of the heat source 52 in the moving direction is zero in the width-direction central portion.

On the other hand, as illustrated in FIGS. 5A and 5C, each of the wide portions 53B of the high-thermal-conductivity portion 53 and the heat generating layer 522 of the heat source 52 overlap each other in a corresponding one of the two width-direction end portions.

That is, the length (denoted by D1 in FIG. 5C) of the area of overlap between the high-thermal-conductivity portion 53 and the heat generating layer 522 of the heat source 52 in the moving direction is shorter in the width-direction central portion than in the width-direction end portions.

In the first exemplary embodiment, the width-direction end portions of the high-thermal-conductivity portion 53 or the heat generating layer 522 refer to regions of the high-thermal-conductivity portion 53 or the heat generating layer 522 that are positioned at two respective ends in the width direction and each have a predetermined length in the width direction. Likewise, the width-direction central portion of the high-thermal-conductivity portion 53 or the heat generating layer 522 refers to a region of the high-thermal-conductivity portion 53 or the heat generating layer 522 that is positioned in the center in the width direction and has a predetermined length in the width direction.

In the first exemplary embodiment, since the length of the area of overlap between the high-thermal-conductivity portion 53 and the heat generating layer 522 in the moving direction is set as described above, the time required for heating the fixing belt 51 to the predetermined temperature at the start of heating of the fixing belt 51 by the heat source 52 is shorter than in a case where, for example, the length of the area of overlap between the high-thermal-conductivity portion 53 and the heat generating layer 522 in the moving direction is equal between the width-direction end portions and the width-direction central portion.

More specifically, since the length of the area of overlap between the high-thermal-conductivity portion 53 and the heat generating layer 522 in the moving direction is shorter in the width-direction central portion than in the width-direction end portions, the heat generated by the heat generating layer 522 of the heat source 52 is more likely to be conducted to the fixing belt 51 than to the high-thermal-conductivity portion 53. Consequently, at the start of heating of the fixing belt 51 by the heat source 52, the temperature of the fixing belt 51 rises more quickly with the heat generated by the heat generating layer 522. Accordingly, the time required for heating the fixing belt 51 to the predetermined temperature is reduced.

As described above, in the first exemplary embodiment, the high-thermal-conductivity portion 53 and the heat generating layer 522 of the heat source 52 do not overlap each other in the width-direction central portion. Therefore, the heat generated by the heat generating layer 522 of the heat source 52 is less likely to be conducted to the high-thermal-conductivity portion 53 but is more likely to be conducted to the fixing belt 51 than in a case where, for example, the high-thermal-conductivity portion 53 and the heat generating layer 522 of the heat source 52 overlap each other in the width-direction central portion. Consequently, at the start of heating of the fixing belt 51 by the heat source 52, the temperature of the fixing belt 51 rises much more quickly with the heat generated by the heat generating layer 522 and the time required for heating the fixing belt 51 to the predetermined temperature becomes shorter than in the case where the high-thermal-conductivity portion 53 and the heat generating layer 522 of the heat source 52 overlap each other in the width-direction central portion.

Meanwhile, as described above, if the sheet P to be subjected to the fixing process has a small width, the temperature tends to rise in the non-sheet-passing areas that are at the width-direction ends of the heat source 52.

To avoid such a situation, in the first exemplary embodiment, the length of the area of overlap between the high-thermal-conductivity portion 53 and the heat generating layer 522 in the moving direction is made longer in the width-direction end portions than in the width-direction central portion, so that the heat generated by the heat generating layer 522 is more assuredly conducted to the high-thermal-conductivity portion 53 in the width-direction end portions. The heat thus conducted from the width-direction end portions of the heat generating layer 522 to the high-thermal-conductivity portion 53 is conducted throughout the high-thermal-conductivity portion 53 in the width direction and is supplied to the width-direction central portion of the heat source 52 that is at a low temperature. Thus, the temperature nonuniformity in the heat source 52 and in the fixing belt 51 is reduced more assuredly.

As illustrated in FIG. 5C and others, the width-direction end portions of the heat generating layer 522 of the heat source 52 overlaps the high-thermal-conductivity portion 53 over the entirety thereof in the moving direction. Therefore, the heat generated by the heat generating layer 522 is more assuredly conducted to the high-thermal-conductivity portion 53 in the width-direction end portions than in a case where the width-direction end portions of the heat generating layer 522 of the heat source 52 each include a region that does not overlap the high-thermal-conductivity portion 53. Consequently, even if the temperature rises in the non-sheet-passing areas at the respective width-direction ends of the heat source 52, the temperature nonuniformity in the heat source 52 and in the fixing belt 51 is reduced more assuredly.

As illustrated in FIG. 5A, the high-thermal-conductivity portion 53 according to the first exemplary embodiment further includes a region that does not overlap the heat generating layer 522 of the heat source 52 over the entirety from one end to the other end in the width direction. Therefore, the heat conducted from the high-temperature portion of the heat source 52 to the high-thermal-conductivity portion 53 is conducted in the width direction through the region that does not overlap the heat generating layer 522. Hence, the heat is more assuredly supplied to the low-temperature portion of the heat source 52. Accordingly, for example, even if the temperature rises in the non-sheet-passing areas corresponding to the width-direction end portions of the heat source 52, the temperature nonuniformity in the heat source 52 and in the fixing belt 51 is reduced more assuredly.

In particular, in the first exemplary embodiment, the region of the high-thermal-conductivity portion 53 that does not overlap the heat generating layer 522 over the entirety from one end to the other end in the width direction corresponds to a region of the high-thermal-conductivity portion 53 that is on the upstream side in the moving direction and adjoins the upstream side face 53C. Hence, with the presence of the high-thermal-conductivity portion 53, the temperature nonuniformity in the fixing belt 51 tends to be reduced before the fixing belt 51 reaches the nip part N.

Furthermore, in the first exemplary embodiment, the region of the high-thermal-conductivity portion 53 that does not overlap the heat generating layer 522 over the entirety from one end to the other end in the width direction overlaps the extended portion 523A of one of the power feeding layers 523 included in the heat source 52. Therefore, while the increase in the size of the heat source 52 in the moving direction is suppressed, the size of the high-thermal-conductivity portion 53 in the moving direction is allowed to be made greater than in a case where the region of the high-thermal-conductivity portion 53 that does not overlap the heat generating layer 522 over the entirety from one end to the other end in the width direction does not overlap the power feeding layer 523.

Second Exemplary Embodiment

A second exemplary embodiment of the present disclosure will now be described. Elements that are the same as those described in the first exemplary embodiment are denoted by corresponding ones of the reference numerals, and detailed description of those elements is omitted herein.

Figure 6A:
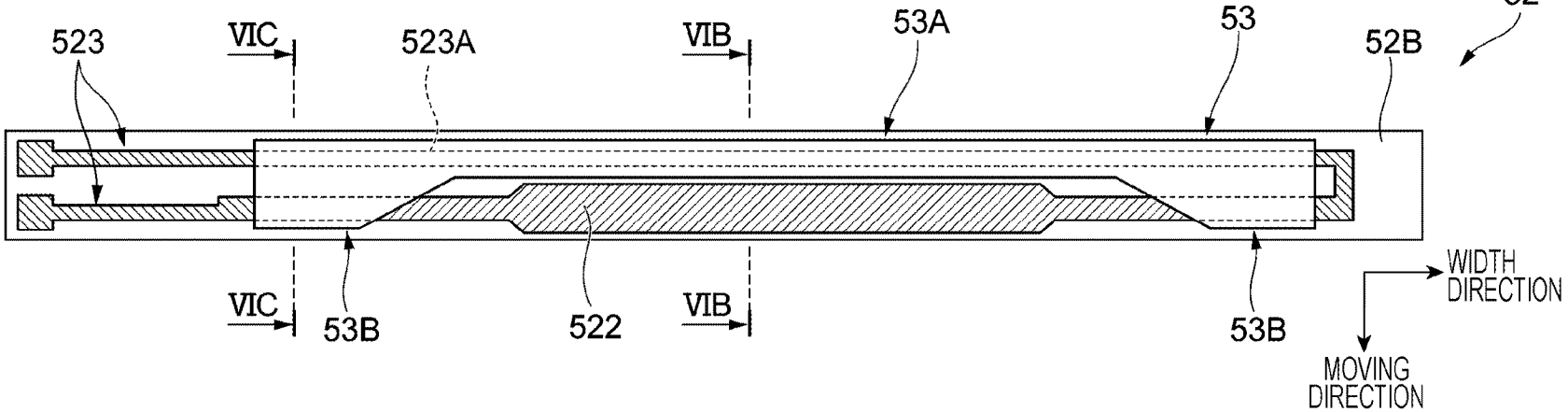
FIGS. 6A to 6C illustrate an arrangement of a heat source and a high-thermal-conductivity portion according to a second exemplary embodiment.
Figure 6B:
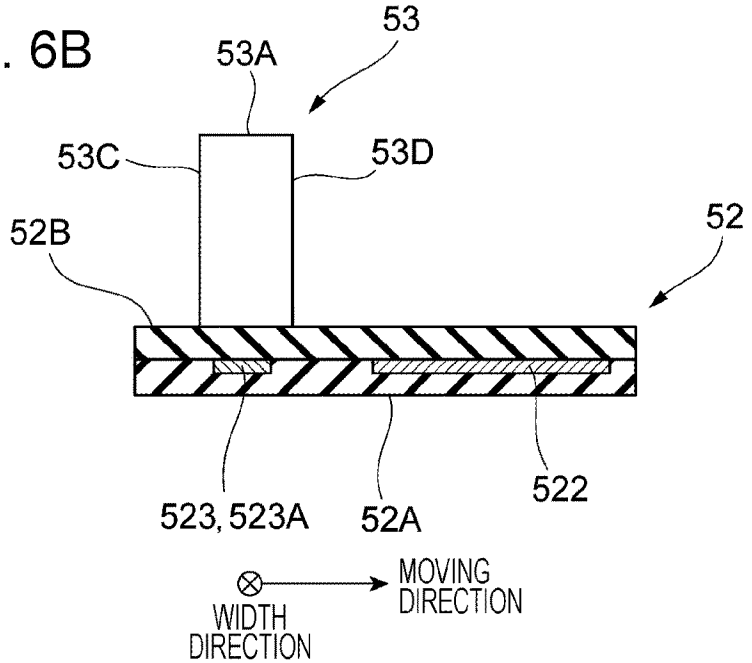
Figure 6C:
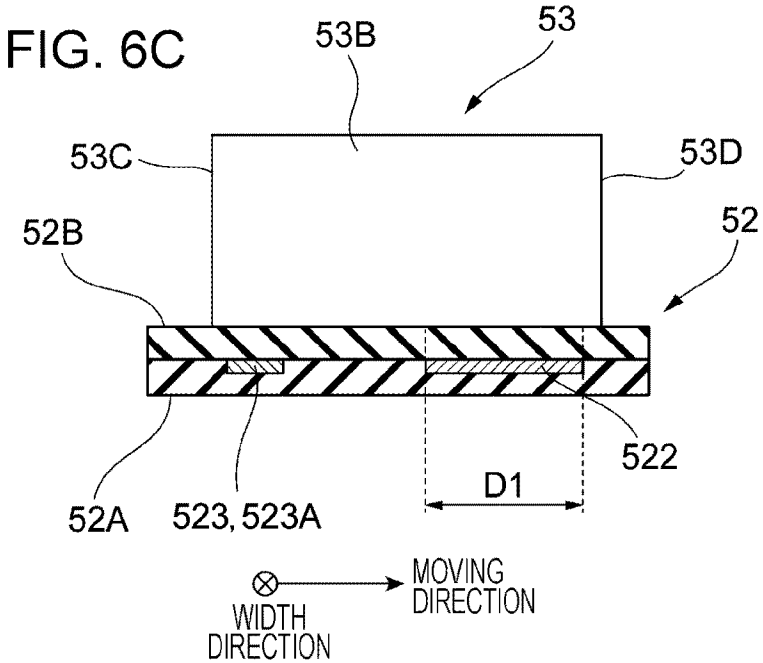

FIGS. 6A to 6C illustrate an arrangement of the heat source 52 and the high-thermal-conductivity portion 53 according to the second exemplary embodiment. FIG. 6A is a plan view of the heat source 52 and the high-thermal-conductivity portion 53 seen in the direction of stacking of the high-thermal-conductivity portion 53 on the heat source 52 (a direction corresponding to the direction VA represented in FIG. 4). FIG. 6B is a sectional view taken along line VIB-VIB illustrated in FIG. 6A. FIG. 6C is a sectional view taken along line VIC-VIC illustrated in FIG. 6A. In FIGS. 6A to 6C, the plurality of high-thermal-conductivity members 531 (see FIG. 4) are collectively illustrated as the high-thermal-conductivity portion 53.

The high-thermal-conductivity portion 53 according to the second exemplary embodiment has the same shape as the high-thermal-conductivity portion 53 according to the first exemplary embodiment. That is, the high-thermal-conductivity portion 53 according to the second exemplary embodiment includes the narrow portion 53A positioned in the width-direction central portion thereof, and wide portions 53B positioned at two respective width-direction ends of the narrow portion 53A and being wider than the narrow portion 53A in the moving direction.

The heat generating layer 522 of the heat source 52 according to the second exemplary embodiment has a different shape from the heat generating layer 522 according to the first exemplary embodiment.

Specifically, the length of the heat generating layer 522 according to the second exemplary embodiment in the moving direction of the fixing belt 51 is smaller in the width-direction end portions thereof than in the width-direction central portion thereof. As described above, the heat generating layer 522 has a higher resistance and generates a greater amount of heat with a smaller length thereof in the moving direction of the fixing belt 51. Hence, in the heat source 52 according to the second exemplary embodiment, the amount of heat generated by the heat generating layer 522 when power is supplied thereto is greater in the width-direction end portions than in the width-direction central portion.

In the second exemplary embodiment, since the high-thermal-conductivity portion 53 and the heat generating layer 522 of the heat source 52 have the respective shapes described above, the length of the area of overlap between the high-thermal-conductivity portion 53 and the heat generating layer 522 of the heat source 52 in the moving direction is shorter in the width-direction central portion than in the width-direction end portions, as with the case of the first exemplary embodiment.

Hence, as with the case of the first exemplary embodiment, the time required for heating the fixing belt 51 to the predetermined temperature at the start of heating of the fixing belt 51 by the heat source 52 is shorter than in the case where the length of the area of overlap between the high-thermal-conductivity portion 53 and the heat generating layer 522 in the moving direction is equal between the width-direction end portions and the width-direction central portion.

Furthermore, as illustrated in FIGS. 6A and 6C and others, the width-direction end portions of the heat generating layer 522 of the heat source 52 where the amount of heat generation is greater each overlap the high-thermal-conductivity portion 53 over the entirety thereof in the moving direction. Hence, the heat generated in the width-direction end portions of the heat generating layer 522 is more assuredly conducted to the high-thermal-conductivity portion 53, and the temperature nonuniformity in the heat source 52 and in the fixing belt 51 is reduced more assuredly with the presence of the high-thermal-conductivity portion 53.

Third Exemplary Embodiment

A third exemplary embodiment of the present disclosure will now be described. Elements that are the same as those described in the first exemplary embodiment are denoted by corresponding ones of the reference numerals, and detailed description of those elements is omitted herein.

Figure 7A:
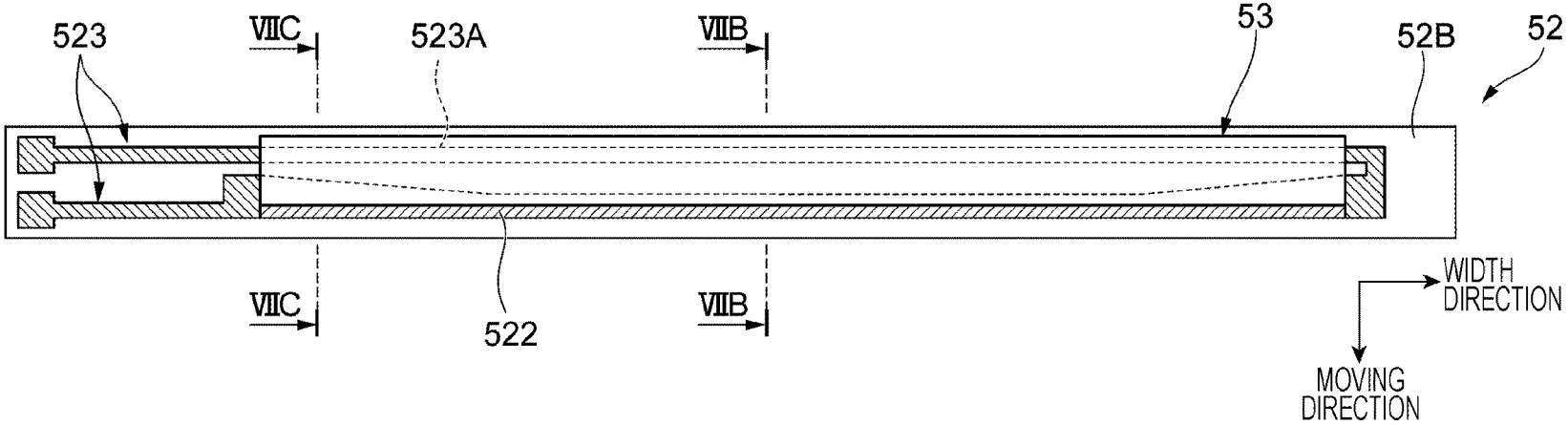
FIGS. 7A to 7C illustrate an arrangement of a heat source and a high-thermal-conductivity portion according to a third exemplary embodiment.
Figure 7B:
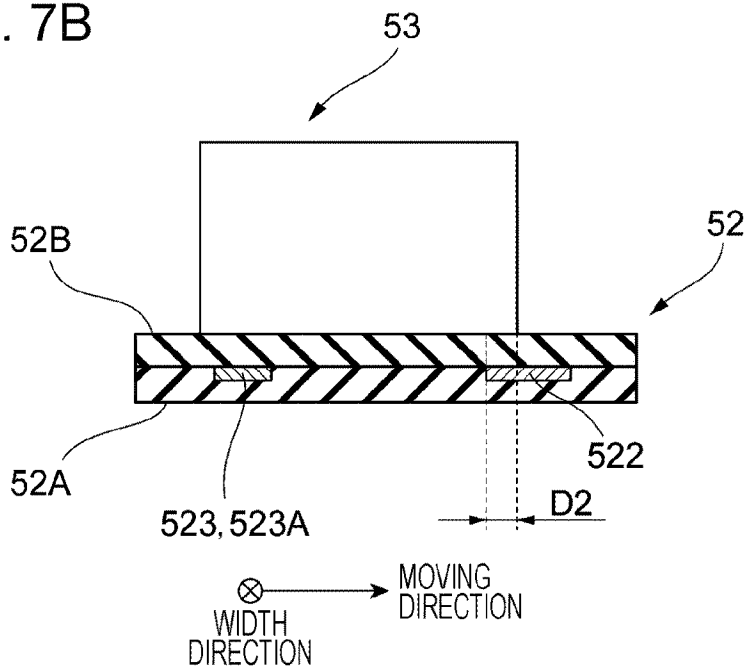
Figure 7C:
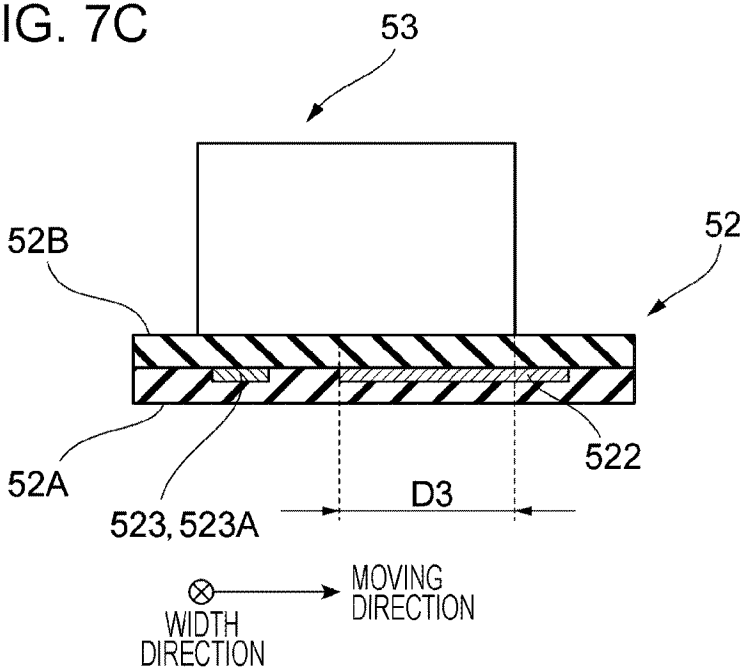

FIGS. 7A to 7C illustrate an arrangement of the heat source 52 and the high-thermal-conductivity portion 53 according to the third exemplary embodiment. FIG. 7A is a plan view of the heat source 52 and the high-thermal-conductivity portion 53 seen in the direction of stacking of the high-thermal-conductivity portion 53 on the heat source 52 (a direction corresponding to the direction VA represented in FIG. 4). FIG. 7B is a sectional view taken along line VIIB-VIIB illustrated in FIG. 7A. FIG. 7C is a sectional view taken along line VIIC-VIIC illustrated in FIG. 7A. In FIGS. 7A to 7C, the plurality of high-thermal-conductivity members 531 (see FIG. 4) are collectively illustrated as the high-thermal-conductivity portion 53.

In the third exemplary embodiment, the length of the heat generating layer 522 of the heat source 52 in the moving direction of the fixing belt 51 is greater in the width-direction end portions thereof than in the width-direction central portion thereof. Hence, in the heat source 52 according to the third exemplary embodiment, the amount of heat generated by the heat generating layer 522 when power is supplied thereto is smaller in the width-direction end portions than in the width-direction central portion.

Meanwhile, the high-thermal-conductivity portion 53 generally has an oblong cuboid shape extending in the width direction. In other words, each of the high-thermal-conductivity members 531 forming the high-thermal-conductivity portion 53 has an oblong rectangular shape extending in the width direction. That is, the length of the high-thermal-conductivity portion 53 according to the third exemplary embodiment in the moving direction is equal between the width-direction central portion and the width-direction end portions.

In the third exemplary embodiment, as with the case of the first exemplary embodiment, the length of the area of overlap between the high-thermal-conductivity portion 53 and the heat generating layer 522 of the heat source 52 in the moving direction is shorter in the width-direction central portion than in the width-direction end portions. In other words, in the third exemplary embodiment, the length of the area of overlap between the high-thermal-conductivity portion 53 and the heat generating layer 522 in the moving direction in the width-direction central portion (a length denoted by D2 in FIG. 7B) is shorter than that in the width-direction end portions (a length denoted by D3 in FIG. 7C) (D2<D3).

Hence, as with the case of the first exemplary embodiment, the time required for heating the fixing belt 51 to the predetermined temperature at the start of heating of the fixing belt 51 by the heat source 52 is shorter than in the case where the length of the area of overlap between the high-thermal-conductivity portion 53 and the heat generating layer 522 in the moving direction is equal between the width-direction end portions and the width-direction central portion.

In the third exemplary embodiment, the heat generating layer 522 of the heat source 52 is shaped such that the length thereof in the moving direction is greater in the width-direction end portions than in the width-direction central portion. Instead, the high-thermal-conductivity portion 53 has a simple shape such as a cuboid as illustrated in FIG. 7A.

Fourth Exemplary Embodiment

A fourth exemplary embodiment of the present disclosure will now be described. Elements that are the same as those described in the first exemplary embodiment are denoted by corresponding ones of the reference numerals, and detailed description of those elements is omitted herein.

FIGS. 8A to 8C illustrate an arrangement of the heat source 52 and the high-thermal-conductivity portion 53 according to the fourth exemplary embodiment. FIG. 8A is a plan view of the heat source 52 and the high-thermal-conductivity portion 53 seen in the direction of stacking of the high-thermal-conductivity portion 53 on the heat source 52 (a direction corresponding to the direction VA represented in FIG. 4). FIG. 8B is a sectional view taken along line VIIIB-VIIIB illustrated in FIG. 8A. FIG. 8C is a sectional view taken along line VIIIC-VIIIC illustrated in FIG. 8A. In FIGS. 8A to 8C, the plurality of high-thermal-conductivity members 531 (see FIG. 4) are collectively illustrated as the high-thermal-conductivity portion 53.

As illustrated in FIG. 8A, the heat source 52 according to the fourth exemplary embodiment includes a plurality of (two in the fourth exemplary embodiment) heat generating layers 522 arranged side by side at intervals in the moving direction of the fixing belt 51 and each extending in the width direction of the fixing belt 51. Specifically, the heat generating layers 522 according to the fourth exemplary embodiment include an upstream heat generating layer 522B and a downstream heat generating layer 522C each extending in the width direction. The upstream heat generating layer 522B is positioned on the upstream side of the heat source 52 in the moving direction. The downstream heat generating layer 522C is positioned on the downstream side with respect to the upstream heat generating layer 522B in the moving direction and at an interval therefrom. The upstream heat generating layer 522B and the downstream heat generating layer 522C are each connected at one width-direction end thereof to the extended portion 523A of one of the power feeding layers 523.

The length of the upstream heat generating layer 522B included in the heat generating layers 522 in the moving direction of the fixing belt 51 is uniform over the entirety thereof from one end to the other end in the width direction. The length of the downstream heat generating layer 522C included in the heat generating layers 522 in the moving direction of the fixing belt 51 is greater in two width-direction ends thereof than in a width-direction central portion thereof.

Furthermore, as with the case of the third exemplary embodiment, the high-thermal-conductivity portion 53 generally has an oblong cuboid shape extending in the width direction. In other words, each of the high-thermal-conductivity members 531 forming the high-thermal-conductivity portion 53 has an oblong rectangular shape extending in the width direction. That is, the length of the high-thermal-conductivity portion 53 according to the fourth exemplary embodiment in the moving direction is equal between the width-direction central portion and the width-direction end portions.

In the fourth exemplary embodiment, as with the case of the first exemplary embodiment, the length of the area of overlap between the high-thermal-conductivity portion 53 and the heat generating layer 522 of the heat source 52 in the moving direction is shorter in the width-direction central portion than in the width-direction end portions. More specifically, the length of the area of overlap, in the moving direction, between the high-thermal-conductivity portion 53 and the downstream heat generating layer 522C included in the plurality of heat generating layers 522 is shorter in the width-direction central portion than in the width-direction end portions. In addition, the upstream heat generating layer 522B included in the heat generating layers 522 overlaps the high-thermal-conductivity portion 53 over the entirety thereof in the moving direction from one end to the other end in the width direction.

Hence, as with the case of the first exemplary embodiment, the time required for heating the fixing belt 51 to the predetermined temperature at the start of heating of the fixing belt 51 by the heat source 52 is shorter than in the case where the length of the area of overlap between the high-thermal-conductivity portion 53 and the heat generating layer 522 in the moving direction is equal between the width-direction end portions and the width-direction central portion.

Fifth Exemplary Embodiment

A fifth exemplary embodiment of the present disclosure will now be described. Elements that are the same as those described in the first exemplary embodiment are denoted by corresponding ones of the reference numerals, and detailed description of those elements is omitted herein.

Figure 9A:
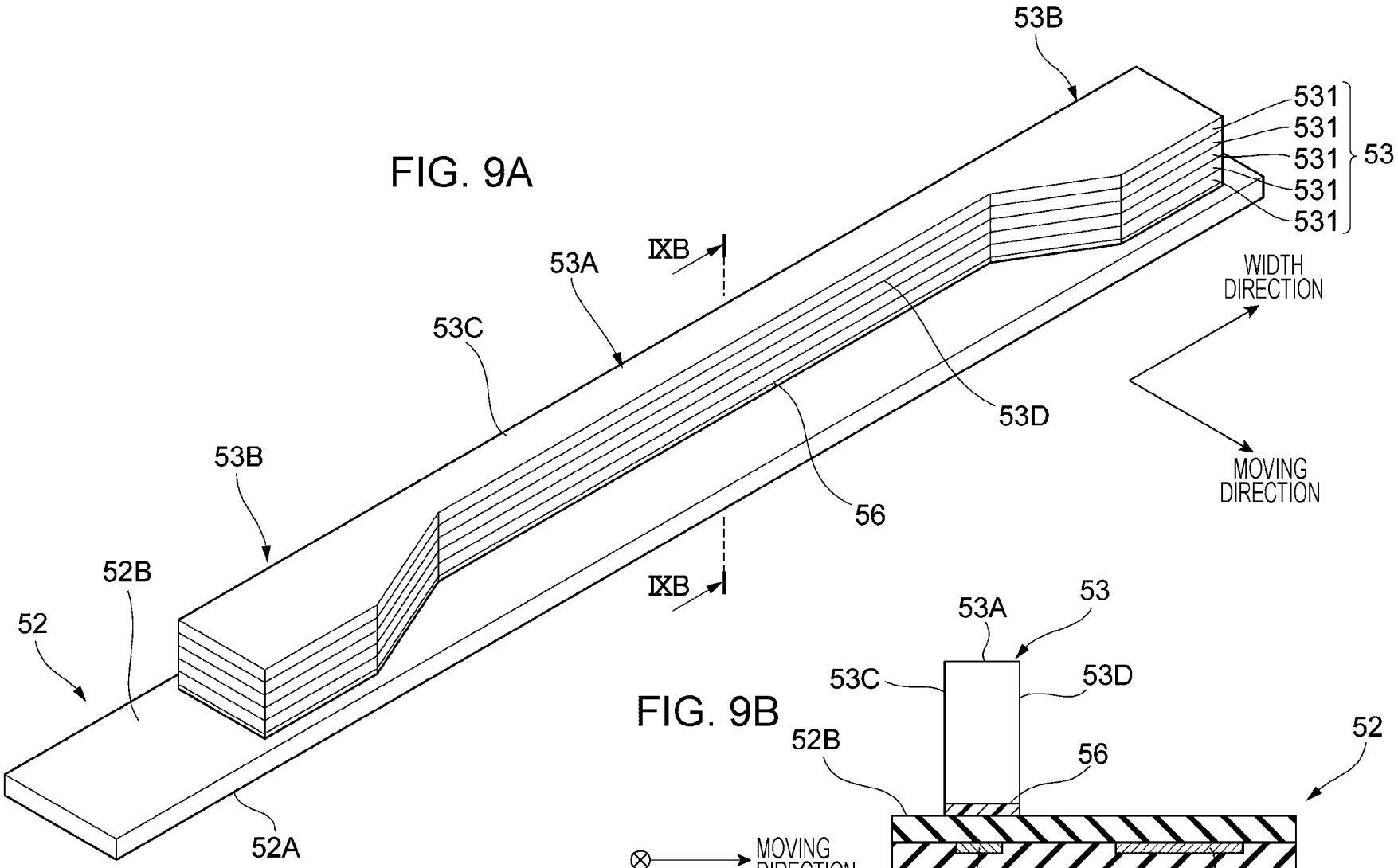
FIGS. 9A and 9B illustrate an arrangement of a heat source, a high-thermal-conductivity portion, and a low-thermal-conductivity portion according to a fifth exemplary embodiment.
Figure 9B:
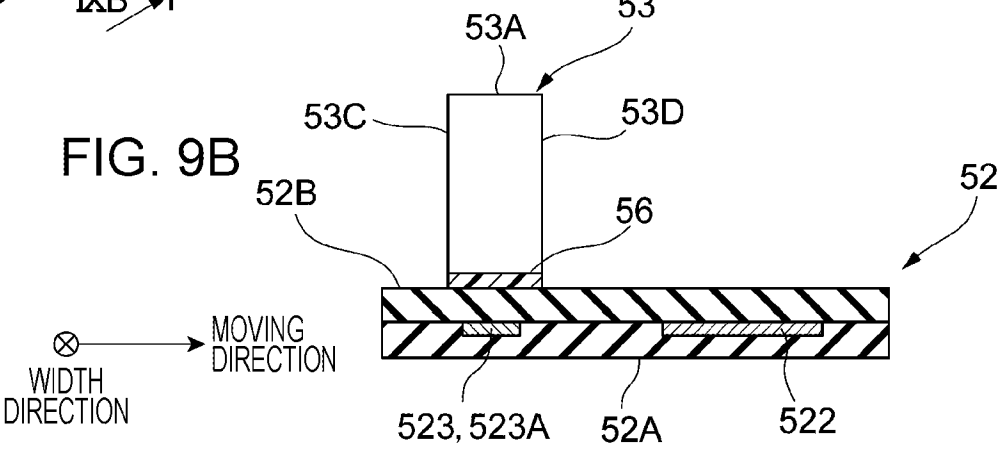

FIGS. 9A and 9B illustrate an arrangement of the heat source 52, the high-thermal-conductivity portion 53, and a low-thermal-conductivity portion 56, to be described below, according to the fifth exemplary embodiment. FIG. 9A is a perspective view illustrating the heat source 52, the high-thermal-conductivity portion 53, and the low-thermal-conductivity portion 56. FIG. 9B is a sectional view taken along line IXB-IXB illustrated in FIG. 9A.

As illustrated in FIGS. 9A and 9B, the high-thermal-conductivity portion 53 according to the fifth exemplary embodiment has the same shape as the high-thermal-conductivity portion 53 according to the first exemplary embodiment. That is, the high-thermal-conductivity portion 53 according to the fifth exemplary embodiment includes the narrow portion 53A positioned in the width-direction central portion thereof, and the wide portions 53B positioned at two respective width-direction ends of the narrow portion 53A and being wider than the narrow portion 53A in the moving direction.

Furthermore, although not illustrated, the heat generating layer 522 of the heat source 52 according to the fifth exemplary embodiment has the same shape as the heat generating layer 522 according to the first exemplary embodiment. That is, the length of the heat generating layer 522 in the moving direction is uniform over the entirety thereof in the width direction.

In the fifth exemplary embodiment, as illustrated in FIGS. 9A and 9B, the low-thermal-conductivity portion 56 having a lower thermal conductivity than the high-thermal-conductivity portion 53 is provided between the opposite surface 52B of the heat source 52 and the high-thermal-conductivity portion 53. In other words, the high-thermal-conductivity portion 53 is provided on the opposite surface 52B of the heat source 52 with the low-thermal-conductivity portion 56 interposed therebetween.

The low-thermal-conductivity portion 56 may have a lower thermal conductivity than a material forming the heat source 52. The low-thermal-conductivity portion 56 is made of, for example, a heat-resisting resin material or the like, such as polyimide, and is provided in the form of a thin film. The low-thermal-conductivity portion 56 has the same shape as the high-thermal-conductivity portion 53 when seen in the direction of stacking of the low-thermal-conductivity portion 56 and the high-thermal-conductivity portion 53 on the heat source 52.

In the fifth exemplary embodiment, since the low-thermal-conductivity portion 56 is provided between the heat source 52 and the high-thermal-conductivity portion 53, the time required for heating the fixing belt 51 to the predetermined temperature at the start of heating of the fixing belt 51 by the heat source 52 is much shorter than in a case where the low-thermal-conductivity portion 56 is not provided.

Specifically, in the fifth exemplary embodiment, since the low-thermal-conductivity portion 56 having a low thermal conductivity is provided, the heat generated by the heat generating layer 522 of the heat source 52 is prevented from being directly conducted to the high-thermal-conductivity portion 53. Hence, the heat generated by the heat generating layer 522 of the heat source 52 is more assuredly conducted to the fixing belt 51. Consequently, at the start of heating of the fixing belt 51 by the heat source 52, the temperature of the fixing belt 51 tends rise quickly with the heat generated by the heat generating layer 522.

In the fifth exemplary embodiment, as described above, the low-thermal-conductivity portion 56 has the same shape as the high-thermal-conductivity portion 53. Furthermore, the high-thermal-conductivity portion 53 has no part that is in direct contact with the heat source 52, instead of through the low-thermal-conductivity portion 56. Hence, the heat generated by the heat generating layer 522 of the heat source 52 is prevented from being directly conducted to the high-thermal-conductivity portion 53 and is more assuredly conducted to the fixing belt 51.

When the fixing belt 51 reaches the predetermined temperature, the temperature of the low-thermal-conductivity portion 56 rises correspondingly. When the temperature of the low-thermal-conductivity portion 56 rises, the heat is gradually conducted from the low-thermal-conductivity portion 56 to the high-thermal-conductivity portion 53.

For example, if the sheet P to be subjected to the fixing process has a small width and the temperature rises in the non-sheet-passing areas corresponding to the width-direction end portions of the heat source 52, the heat is conducted from the width-direction end portions of the heat source 52 to the high-thermal-conductivity portion 53 through the low-thermal-conductivity portion 56. The heat thus conducted from the width-direction end portions of the heat source 52 to the high-thermal-conductivity portion 53 is conducted throughout the high-thermal-conductivity portion 53 in the width direction and is supplied to the width-direction central portion of the heat source 52 that is at a low temperature. Thus, the temperature nonuniformity in the heat source 52 and in the fixing belt 51 is reduced.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A fixing device comprising:

a contact portion that comes into contact with a recording material transported;

a heat source that heats the contact portion and includes a heat generator extending in a width direction intersecting a transport direction in which the recording material is transported, and a support portion supporting the heat generator, the heat source having a counter surface that faces the contact portion, and an opposite surface; and a high-thermal-conductivity portion provided on the opposite surface of the heat source and extending continuously in the width direction such that at least a part of the high-thermal-conductivity portion overlaps the heat generator of the heat source, the high-thermal-conductivity portion having a higher thermal conductivity than at least one of materials forming the support portion and the contact portion, wherein a length of an area of overlap between the high-thermal-conductivity portion and the heat generator of the heat source in the transport direction is shorter in a width-direction central portion than in two width-direction end portions, wherein the heat generator is disposed in the heat source at an opposite side from the counter surface.

2. The fixing device according to claim 1, wherein the high-thermal-conductivity portion and the heat generator of the heat source do not overlap each other in the width-direction central portion.

3. The fixing device according to claim 1, wherein a length of the high-thermal-conductivity portion in the transport direction is shorter in the width-direction central portion than in the width-direction end portions.

4. The fixing device according to claim 3, wherein the heat generator of the heat source overlaps the high-thermal-conductivity portion over an entirety of the heat generator in the transport direction in the width-direction end portions.

5. The fixing device according to claim 4, wherein the heat generator of the heat source generates a greater amount of heat in the width-direction end portions than in the width-direction central portion.

6. The fixing device according to claim 1, wherein the high-thermal-conductivity portion does not overlap an entirety of the heat generator in the width direction.

7. The fixing device according to claim 6, wherein the region of the high-thermal-conductivity portion that does not overlap the heat generator is positioned on an upstream side with respect to the heat generator in the transport direction.

8. The fixing device according to claim 6, wherein the heat source includes an electrode portion extending in the width direction and that supplies electric power to the heat generator, and wherein the region of the high-thermal-conductivity portion that does not overlap the heat generator overlaps the electrode portion.

9. The fixing device according to claim 1, further comprising:

a low-thermal-conductivity portion provided in contact with the opposite surface of the heat source and extending in the width direction such that at least a part of the low-thermal-conductivity portion overlaps the heat generator of the heat source, the low-thermal-conductivity portion having a lower thermal conductivity than the high-thermal-conductivity portion, wherein the high-thermal-conductivity portion is provided on the opposite surface of the heat source with the low-thermal-conductivity portion provided in between.

10. The fixing device according to claim 9, wherein the low-thermal-conductivity portion has a same shape as the high-thermal-conductivity portion.

11. The fixing device according to claim 1, wherein the high-thermal-conductivity portion includes a plurality of plate-like members stacked one on top of another and each having a plate-like shape extending in the width direction; and heat-conducting viscous liquid provided between adjoining ones of the plate-like members, and wherein a length of an area of overlap between each of the plate-like members and the heat generator in the transport direction is shorter in the width-direction central portion than in the width-direction end portions.

12. An image forming apparatus comprising:

an image forming device that forms an image on a recording material; and a fixing device that fixes the image formed by the image forming device to the recording material, wherein the fixing device is the fixing device according to claim 1.

13. A fixing device comprising:

a contact portion that comes into contact with a recording material transported;

a heat source that heats the contact portion and includes a heat generator extending in a width direction intersecting a transport direction in which the recording material is transported, and a support portion supporting the heat generator, the heat source having a counter surface that faces the contact portion, and an opposite surface; and a high-thermal-conductivity portion provided on the opposite surface of the heat source and extending in the width direction such that at least a part of the high-thermal-conductivity portion overlaps the heat generator of the heat source, the high-thermal-conductivity portion having a higher thermal conductivity than at least one of materials forming the support portion and the contact portion, wherein a length of an area of overlap between the high-thermal-conductivity portion and the heat generator of the heat source in the transport direction is shorter in a width-direction central portion than in two width-direction end portions, wherein a length of the heat generator of the heat source in the transport direction is shorter in the width-direction central portion than in the width-direction end portions, and wherein a length of the high-thermal-conductivity portion in the transport direction is equal between the width-direction end portions and the width-direction central portion.

14. A fixing device comprising:

a contact portion that comes into contact with a recording material transported;

a heat source that heats the contact portion and includes a heat generator extending in a width direction intersecting a transport direction in which the recording material is transported, and a support portion supporting the heat generator, the heat source having a counter surface that faces the contact portion, and an opposite surface; and a high-thermal-conductivity portion provided on the opposite surface of the heat source and extending in the width direction such that at least a part of the high-thermal-conductivity portion overlaps the heat generator of the heat source, the high-thermal-conductivity portion having a higher thermal conductivity than at least one of materials forming the support portion and the contact portion, wherein a length of an area of overlap between the high-thermal-conductivity portion and the heat generator of the heat source in the transport direction is shorter in a width-direction central portion than in two width-direction end portions, wherein the high-thermal-conductivity portion includes, a narrow portion positioned in the width-direction central portion; and two wide portions positioned at two respective width-direction ends of the narrow portion, and being wider than the narrow portion in a moving direction, wherein a length of the narrow portion in the moving direction gradually increases toward each of the wide portions at the two respective width-direction ends of the narrow portion.

* * * * *